US012759766B2

(12) United States Patent
Petlak et al.

(10) Patent No.: US 12,759,766 B2
(45) Date of Patent: Oct. 13, 2026

(54) STRAWLESS DRINKING LID FOR A CONTAINER

(71) Applicant: PACTIV LLC, Lake Forest, IL (US)

(72) Inventors: Frank A. Petlak, Antioch, IL (US); Jeff Hautzinger, Chicago, IL (US); Mark R. Gartz, Mt. Prospect, IL (US); Sam T. Baricovich, Lisle, IL (US)

(73) Assignee: PACTIV LLC, Lake Forest, IL (US)

( * ) Notice: Subject to any disclaimer, the term of this patent is extended or adjusted under 35 U.S.C. 154(b) by 53 days.

(21) Appl. No.: 18/606,218

(22) Filed: Mar. 15, 2024

(65) Prior Publication Data

US 2025/0289627 A1 Sep. 18, 2025

Related U.S. Application Data

(60) Provisional application No. 63/493,590, filed on Mar. 31, 2023.

(51) Int. Cl.
*B65D 47/06* (2006.01)
*B65D 43/02* (2006.01)

(52) U.S. Cl.
CPC ..... *B65D 47/065* (2013.01); *B65D 43/0212* (2013.01); *B65D 2543/00046* (2013.01); *B65D 2543/00092* (2013.01); *B65D 2543/00296* (2013.01); *B65D 2543/00351* (2013.01)

(58) Field of Classification Search
CPC .. B65D 47/065; B65D 47/066; B65D 47/063; B65D 47/061; B65D 47/2018; B65D 25/44
See application file for complete search history.

(56) References Cited

U.S. PATENT DOCUMENTS 3,227,304 A 1/1966 Ashury
3,362,569 A 1/1968 Geiger
3,927,794 A 12/1975 Erdman
(Continued)

FOREIGN PATENT DOCUMENTS

CA 1 007 183 A 3/1977
CA 3 108 021 A1 2/2020
(Continued)

OTHER PUBLICATIONS

U.S. Appl. No. 18/606,575, filed Mar. 15, 2024.
U.S. Appl. No. 18/606,575, Nov. 4, 2025 Non-Final Office Action.

*Primary Examiner* — Jeffrey R Allen
(74) *Attorney, Agent, or Firm* — Baker Botts L.L.P.

(57) ABSTRACT

Strawless drinking lid for a container, having a mounting portion defining an outer perimeter and a perimeter wall disposed inwardly from the mounting portion. The perimeter wall extends upwardly relative the mounting portion and has an outer surface facing the mounting portion and an inner surface opposite the outer surface. The strawless drinking lid further has a center portion extending inwardly from the inner surface of the perimeter wall and a recessed drinking portion extending from the center portion. The recessed drinking portion includes an upper surface having a front section and a back section with a hinge therebetween. The front section has a front edge proximate a ledge extending from the inner surface of the perimeter wall. The recessed drinking portion has a closed configuration and an open configuration.

20 Claims, 10 Drawing Sheets

(56) References Cited

U.S. PATENT DOCUMENTS

| | | | | |
|---|---|---|---|---|
| 3,929,251 | A | 12/1975 | Urmston | |
| 4,113,135 | A | 9/1978 | Yamazaki | |
| 4,184,604 | A | 1/1980 | Amberg et al. | |
| 4,925,051 | A | 5/1990 | Herbst | |
| 6,419,105 | B1 | 7/2002 | Bruce et al. | |
| 7,691,302 | B2 | 4/2010 | Hollis et al. | |
| 7,753,224 | B2 | 7/2010 | Cai | |
| 7,789,260 | B2 | 9/2010 | Hollis et al. | |
| 7,819,271 | B2 | 10/2010 | Hollis et al. | |
| 8,113,379 | B2 | 2/2012 | Cai et al. | |
| 8,317,050 | B2 | 11/2012 | Hollis et al. | |
| D887,203 | S | 6/2020 | Pan | |
| D890,568 | S | 7/2020 | Davis | |
| 10,759,574 | B1 | 9/2020 | Li | |
| D900,605 | S | 11/2020 | Li | |
| D921,423 | S | 6/2021 | Horgan et al. | |
| 2007/0131691 | A1 | 6/2007 | Evans | |
| 2019/0276199 | A1* | 9/2019 | Wood | B65D 47/063 |
| 2020/0062462 | A1 | 2/2020 | Baird | |

FOREIGN PATENT DOCUMENTS

| | | | |
|---|---|---|---|
| CA | 3 137 650 | A1 | 12/2020 |
| WO | WO 2018/096503 | A1 | 5/2018 |
| WO | WO 2022/086876 | A1 | 4/2022 |

* cited by examiner

STRAWLESS DRINKING LID FOR A CONTAINER

CROSS REFERENCE TO RELATED APPLICATIONS

This application claims the benefit of U.S. Provisional Patent Application No. 63/493,590 filed Mar. 31, 2023, which is hereby incorporated by reference in its entirety.

BACKGROUND

Field of the Disclosed Subject Matter

The disclosed subject matter relates generally to the field of containers, specifically, the construction of a lid for a container such as a cup, bowl or the like. More specifically, the disclosed subject matter relates to a strawless drinking lid for a container and a method of forming the same.

Description of the Related Art

A variety of lids for containers, such as cup, bowl or the like for food and beverages, are well known in the art. Such container lids are relatively inexpensive and disposable; and therefore are extremely popular. In particular, container lids that are strawless and reclosable are often used at parties, picnics, gatherings, and other everyday occasions where portability and minimal clean-up are desired.

A disadvantage of many existing non-reclosable and reclosable container lid designs is that conventional non-reclosable and reclosable container lids often contain pre-stamped through-holes for sipping or straws. Such through-holes require slugs to be removed and collected during manufacture, which add an extra step to the manufacture process. Moreover, since such non-reclosable and reclosable container lids are manufactured with the sip hole open, this is a disadvantage for delivery services and other occasions where ease of portability and use are necessary, and can cause other concerns. Other existing reclosable container lid designs, such as hinged flap designs, tethered plug designs, attached plug designs, and accessory plug designs, can be difficult to operate and require more dexterity. Such existing reclosable container lid designs with flaps or plugs have the additional disadvantages of a flap or plug that can be inconvenient while drinking or snag when closing the container. Moreover, tethered/attached/accessory plug designs can be more difficult to manufacture, have additional assembly or manufacturing costs, and uses additional plastic (i.e., not a green solution).

The disclosed subject matter is intended to provide a strawless drinking lid for a container which provides a solution to the recognized problems.

SUMMARY OF THE DISCLOSED SUBJECT MATTER

The purpose and advantages of the disclosed subject matter will be set forth in and apparent from the description that follows, as well as will be learned by practice of the disclosed subject matter. Additional advantages of the disclosed subject matter will be realized and attained by the methods and systems particularly pointed out in the written description and claims hereof, as well as from the appended drawings.

The disclosed subject matter includes a strawless drinking lid for a container having a mounting portion defining an outer perimeter and a perimeter wall disposed inwardly from the mounting portion. The perimeter wall extends upwardly relative the mounting portion and has an outer surface facing the mounting portion and an inner surface opposite the outer surface. The strawless drinking lid for a container further has a center portion extending inwardly from the inner surface of the perimeter wall and a recessed drinking portion extending from the center portion. The recessed drinking portion includes an upper surface having a front section and a back section with a hinge therebetween. The front section has a front edge proximate a ledge extending from the inner surface of the perimeter wall. The recessed drinking portion has a closed configuration with the upper surface having an undeformed concave shape relative to the center portion and the front edge adjacent the ledge extending from the inner surface of the perimeter wall, and the recessed drinking portion has an open configuration with the back section of the upper surface deformed upwardly to define an opening between the front edge and the ledge extending from the inner surface of the perimeter wall.

As embodied herein, the recessed drinking portion can be configured to be moved from the closed configuration toward the open configuration by an external opening force applied on the front section of the upper surface to deform the front section relative to the center portion. The front section can be configured to conform to the hinge in the open configuration, and the front section can invert upwardly as the front section conforms to the hinge. The recessed drinking portion can be configured to be moved from the open configuration toward the closed configuration by an external closing force applied on the back section of the upper surface to return the back section to the undeformed concave shape. The back section of the upper surface can be deformed past a point of maximum opening stress. The front section of the upper surface can be deformed past a point of maximum closing stress As embodied herein, the front edge can be a curve defined along an interface between the upper surface of the recessed drinking portion and the ledge extending from the inner surface of the perimeter wall. The hinge can be a curve defined along an interface between the front section and the back section of the upper surface. The front edge of the recessed drinking portion can be defined by a cut, perforation or score.

As embodied herein, the perimeter wall can have a front wall segment and a back wall segment. The front wall segment can have a maximum height greater than a maximum height of the back wall segment. The front wall segment can taper down from the maximum height of the front wall segment to the maximum height of the back wall segment. The front wall segment can have a maximum height of approximately 0.38 to 0.75 inch relative to a top of the mounting portion.

As embodied herein, the mounting portion can be configured to engage an upper rim of a container. The mounting portion can include an inner shelf extending radially inward to the outer surface of the perimeter wall. The outer perimeter defined by the mounting portion can be circular in plan view. The strawless drinking lid can consist essentially of a single-piece thermoformed polymer article.

The disclosed subject matter also includes a method of making a strawless drinking lid for a container, including providing a sheet of thermoformable polymeric material and thermoforming the sheet to create a hollow body including a mounting portion defining an outer perimeter. The hollow body further includes a perimeter wall disposed inwardly from the mounting portion, the perimeter wall extending upwardly relative the mounting portion and having an outer surface facing the mounting portion and an inner surface opposite the outer surface. The hollow body further includes a center portion extending inwardly from the inner surface of the perimeter wall, and a recessed drinking portion extending from the center portion, the recessed drinking portion including an upper surface having a front section and a back section with a hinge therebetween, the front section having a front edge proximate a ledge extending from the inner surface of the perimeter wall. The hollow body further includes the recessed drinking portion having a closed configuration with the upper surface having an undeformed concave shape relative to the center portion and the front edge adjacent the ledge extending from the inner surface of the perimeter wall, and the recessed drinking portion having an open configuration with the back section of the upper surface deformed upwardly to define an opening between the front edge and the ledge extending from the inner surface of the perimeter wall.

As embodied herein, the recessed drinking portion can be configured to be moved from the closed configuration toward the open configuration by an external opening force applied on the front section of the upper surface to deform the front section relative to the center portion past a point of maximum closing stress. The back section of the upper surface can be deformed past a point of maximum opening stress. The front section of the upper surface can be deformed past a point of maximum closing stress.

It is to be understood that both the foregoing general description and the following detailed description are exemplary and are intended to provide further explanation of the disclosed subject matter.

The accompanying drawings, which are incorporated in and constitute part of this specification, are included to illustrate and provide a further understanding of the method and system of the disclosed subject matter. Together with the description, the drawings serve to explain the principles of the disclosed subject matter.

BRIEF DESCRIPTION OF THE DRAWINGS

FIG. 8B top view of the lid of FIG. 8A.

FIG. 9B top view of the lid of FIG. 9A.

DETAILED DESCRIPTION OF THE DISCLOSED SUBJECT MATTER

Reference will now be made in detail to the embodiments of the disclosed subject matter, an example of which is illustrated in the accompanying drawings.

Disclosed herein is a strawless drinking lid for a container having a mounting portion defining an outer perimeter and a perimeter wall disposed inwardly from the mounting portion. The perimeter wall extends upwardly relative the mounting portion and has an outer surface facing the mounting portion and an inner surface opposite the outer surface. The strawless drinking lid for a container further has a center portion extending inwardly from the inner surface of the perimeter wall and a recessed drinking portion extending from the center portion. The recessed drinking portion includes an upper surface having a front section and a back section with a hinge therebetween. The front section has a front edge proximate a ledge extending from the inner surface of the perimeter wall. The recessed drinking portion has a closed configuration with the upper surface having an undeformed concave shape relative to the center portion and the front edge adjacent the ledge extending from the inner surface of the perimeter wall, and the recessed drinking portion has an open configuration with the back section of the upper surface deformed upwardly to define an opening between the front edge and the ledge extending from the inner surface of the perimeter wall.

Figure 1:
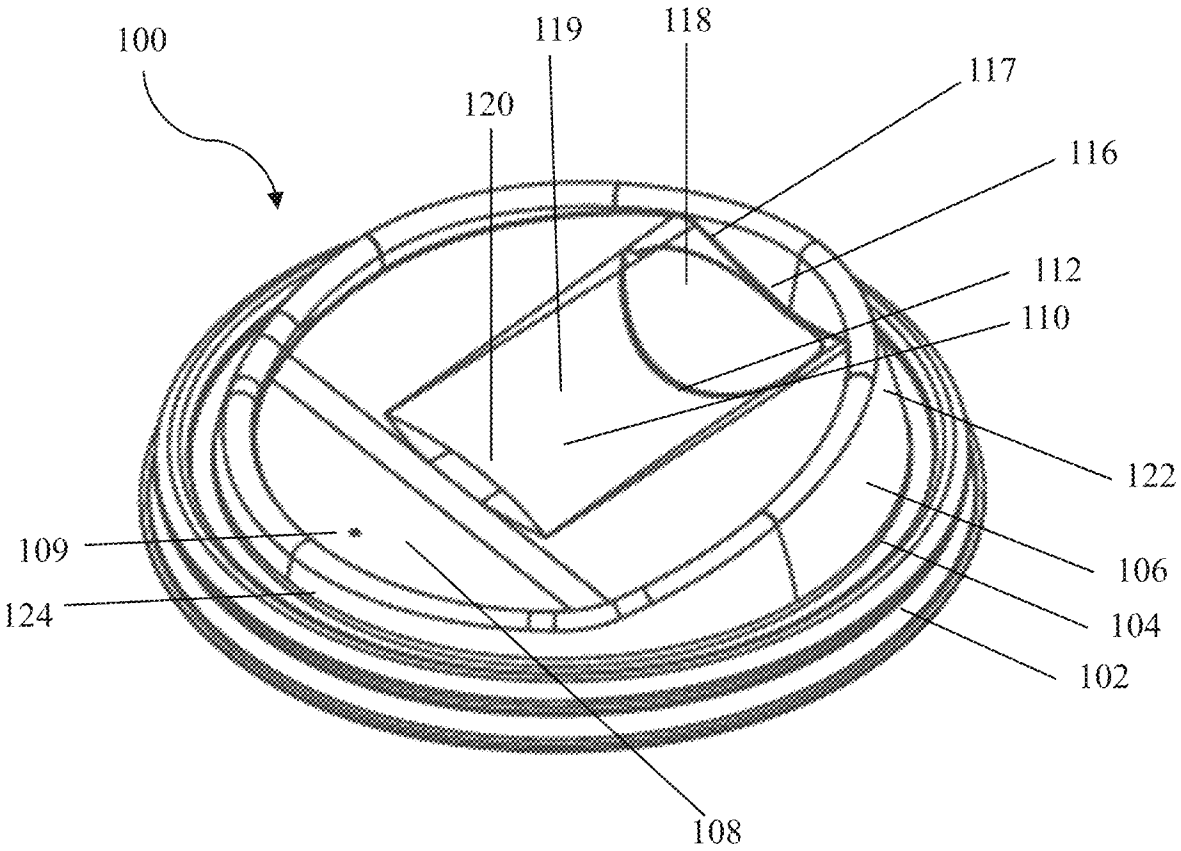
FIG. 1 is a perspective view of a lid for a container according to an aspect of the disclosed subject matter.

For purpose of explanation and illustration, and not limitation, an exemplary container lid in accordance with the disclosed subject matter is shown in FIG. 1 as is designated by reference character 100. While the disclosed subject matter is particularly designed for use with cups, other types of containers may also be capable of utilizing and benefiting from the disclosed subject matter. The disclosed subject matter can be used for a wide variety of containers, including but not limited to beverage cups, food containers, plates, and lids. Additionally, as used herein, the terms "front," "rear," "back," "side," "top," "bottom," "inner," and "outer" are used for the purpose of illustration only, and not limitation. That is, it is recognized that the terms "front," "rear," "back," "side," "top," "bottom," "inner," and "outer" are merely used herein as a point of reference.

As embodied herein and depicted in FIGS. 1-4, the strawless drinking lid 100 for a container has a mounting portion 102 defining an outer perimeter and a perimeter wall 106 disposed inwardly from the mounting portion 102. The perimeter wall 106 extends upwardly relative the mounting portion 102 and has an outer surface facing the mounting portion 102 and an inner surface opposite the outer surface. The strawless drinking lid 100 further has a center portion 108 extending inwardly from the inner surface of the perimeter wall 106 and a recessed drinking portion 110 extending from the center portion 108. The recessed drinking portion 110 includes an upper surface 119 having a front section 118 and a back section 120 with a hinge 112 therebetween. The front section 118 has a front edge 116 proximate a ledge 117 extending from the inner surface of the perimeter wall 106. The recessed drinking portion 110 has a closed configuration with the upper surface 119 having an undeformed concave shape relative to the center portion 108 and the front edge 116 adjacent the ledge 117 extending from the inner surface of the perimeter wall 106, and the recessed drinking portion 110 has an open configuration with the back section 120 of the upper surface 119 deformed upwardly to define an opening between the front edge 116 and the ledge 117 extending from the inner surface of the perimeter wall 106. During the process of deformation, specifically in opening or closing the strawless drinking lid, an external force is applied which deforms the material of the front section 118 or back section 120 past a point of maximum stress, resulting in recessed drinking portion 110 maintained in an open or closed configuration.

As shown generally in FIGS. 1-4, the recessed drinking portion 110 can be configured to be moved from the closed configuration toward the open configuration by an external opening force applied on the front section 118 of the upper surface 119 to deform the front section 118 relative to the center portion 108 past a point of maximum opening stress, such that a drinking area of the lid is open and the recessed drinking portion 110 is maintained in the open configuration. For example, and for purpose of illustration and not limitation, when the recessed drinking portion 110 has an open configuration, the front section 118 can be configured to conform to the hinge 112 in the open configuration, and the front section 118 can invert upwardly (i.e., in a convex configuration) as the front section 118 conforms to the hinge 112. The front section 118 can flex upwardly by a maximum amount that can be defined by the amount of curve (cord height) of the hinge 112. The height of the convex dome can be equal to, or less than, a cord height of the hinge 112. For purpose of illustration and not limitation, the cord height of the hinge 112 can be between 0.30 to 0.35 inch, although any suitable dimensions can be used. For example, and for purpose of illustration and not limitation, the back section 120 can be configured to be relatively fixed when the recessed drinking portion 110 has an open configuration, substantially parallel to the center portion 108, or deformed in a convex shape when the recessed drinking portion 110 has an open configuration. The recessed drinking portion 110 can be configured to be moved from the open configuration toward the closed configuration by an external closing force applied on the back section 120 of the upper surface 119 past a point of maximum closing stress to return the back section 120 to the undeformed concave shape, such that a drinking area of the lid is closed and the recessed drinking portion 110 is maintained in the closed configuration.

As shown generally in FIGS. 1-4, the front edge 116 can be any suitable shape and dimension, including but not limited to a curve defined along an interface between the upper surface 119 of the recessed drinking portion 110 and the ledge extending from the inner surface of the perimeter wall 106. The hinge 112 can be any suitable shape and dimension, including but not limited to a curve defined along an interface between the front and back sections 118, 120 of the upper surface 119 or arcuate. The hinge 112 can be located closer to the front section 118 of the upper surface 119 than the back section 120 of the upper surface 119. The front edge 116 of the recessed drinking portion 110 can be defined by any suitable method of separation, including, but not limited to a partial or full cut, perforation or score. The recessed portion 110 can have left and right side edges that are any suitable shape and dimension, including but not limited to linear. The recessed portion 110 can have a back edge that is any suitable shape and dimension, including but not limited to curved.

Figure 2:
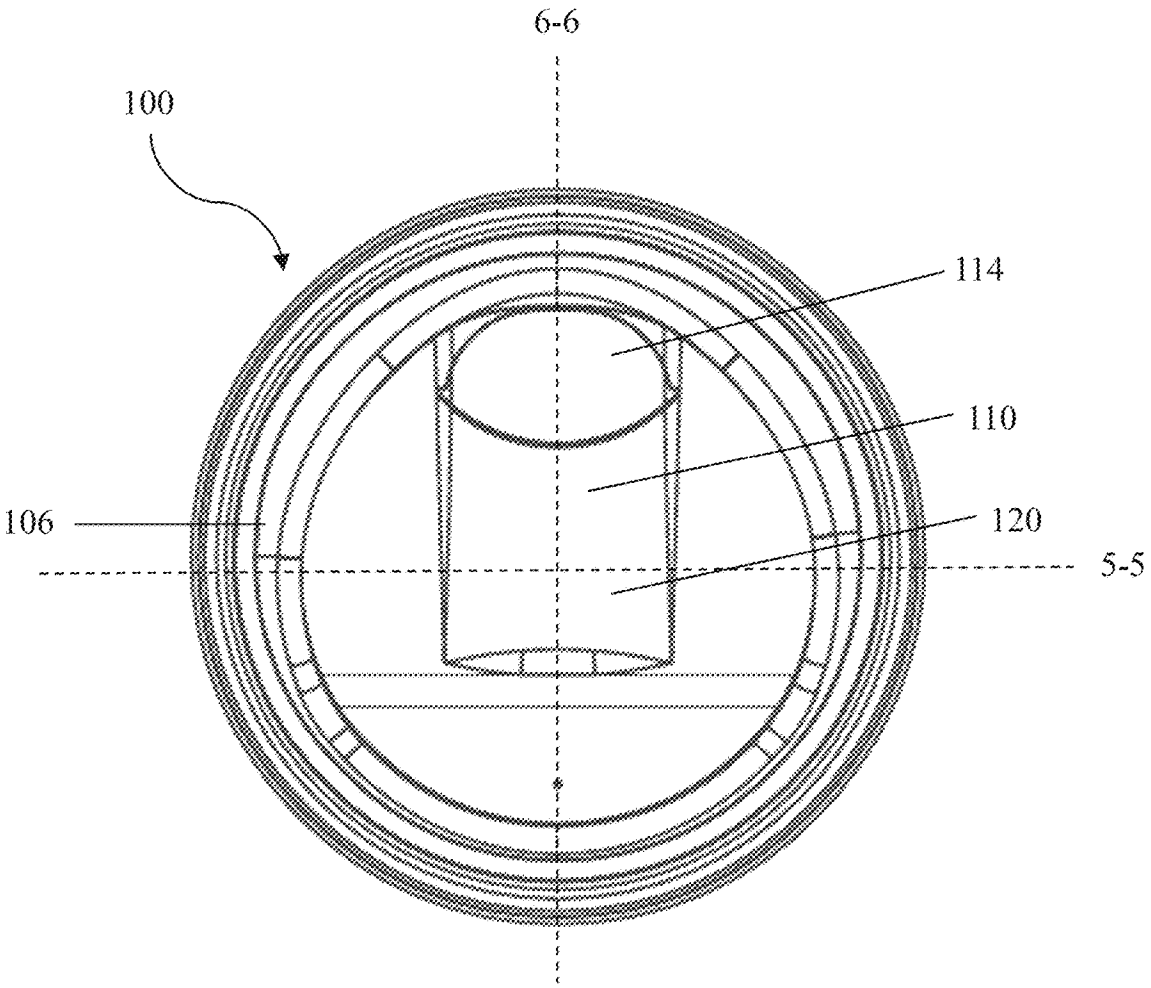
FIG. 2 is a top view of the lid of FIG. 1.
Figure 3:
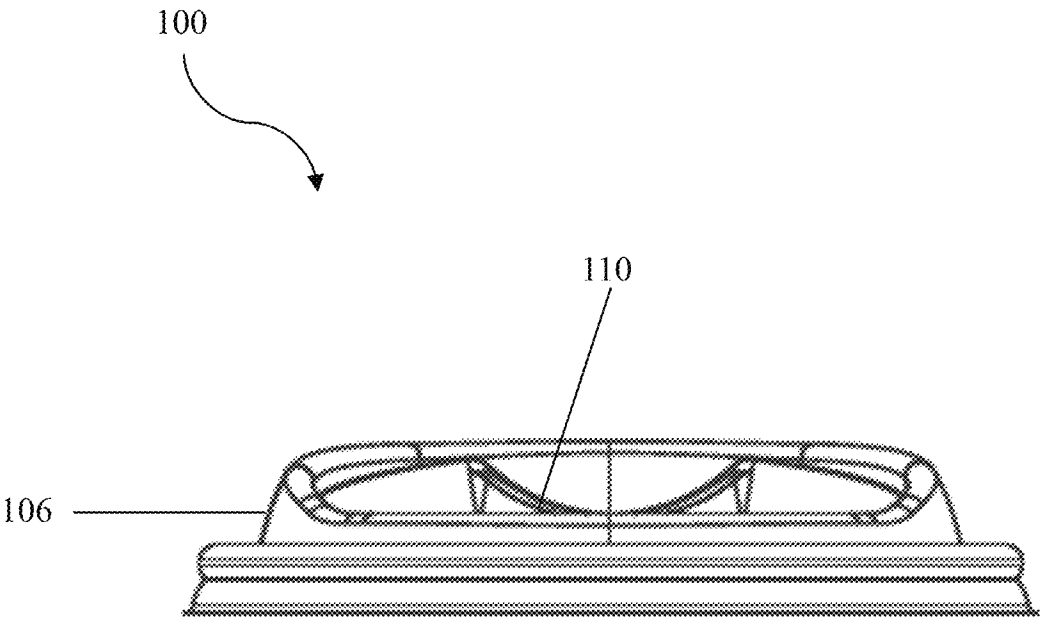
FIG. 3 is a rear side view of the lid of FIG. 1.
Figure 4:
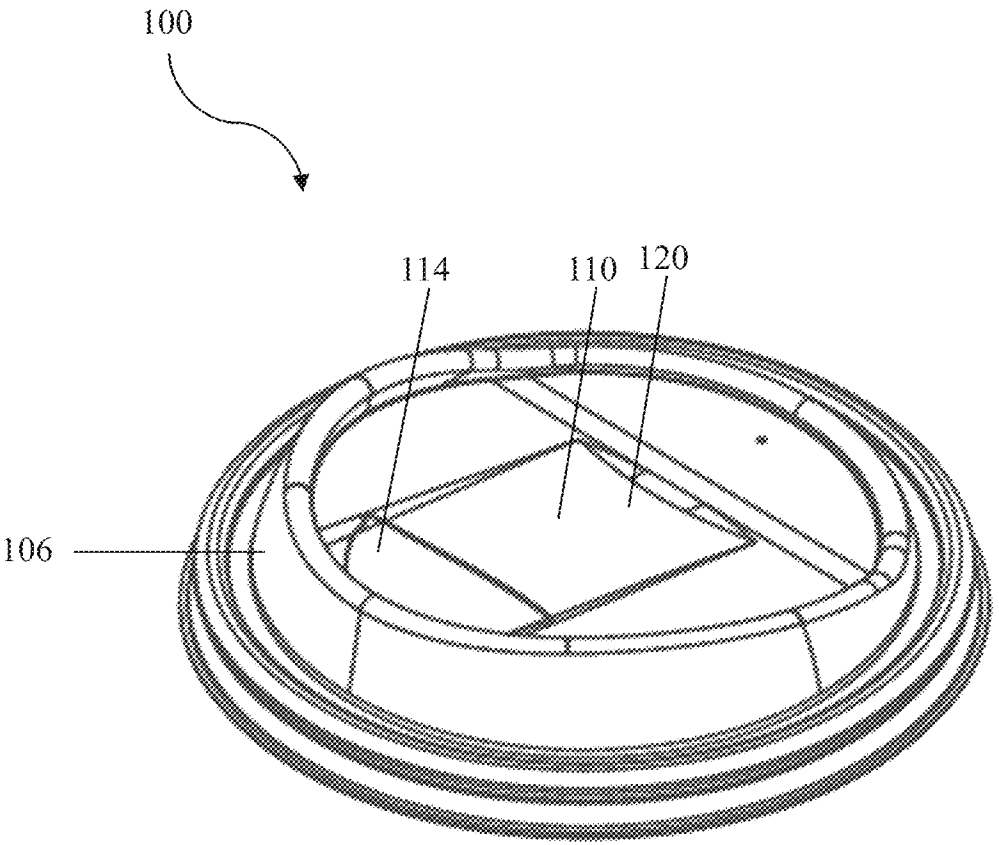
FIG. 4 is a perspective view of the lid of FIG. 1.
Figure 5:
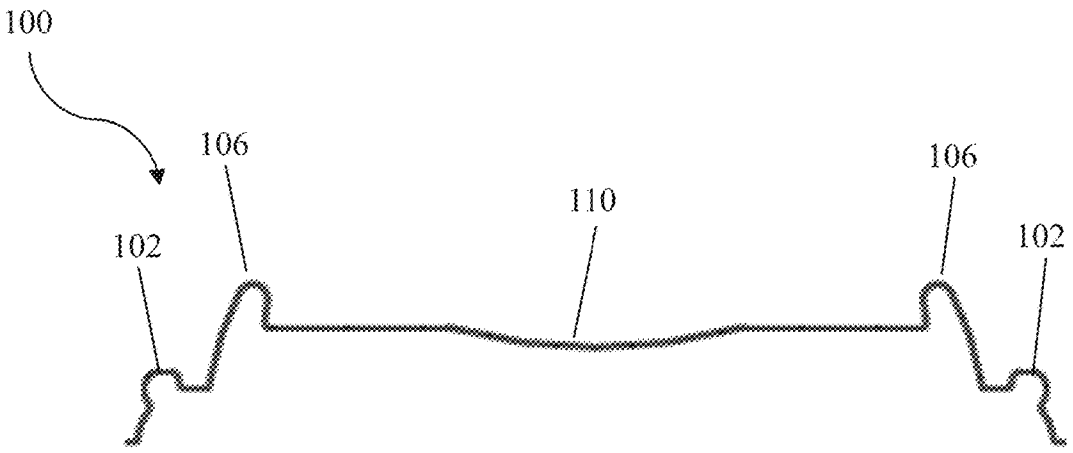
FIG. 5 is a cross-sectional rear side view of the lid of FIG. 1, taken along line 5-5.
Figure 6:
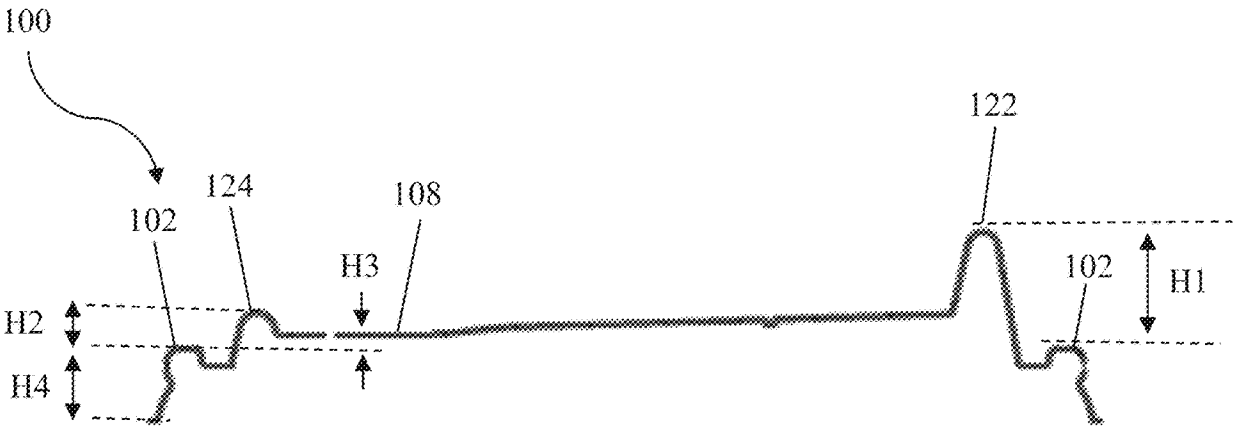
FIG. 6 is a cross-sectional right side view of the lid of FIG. 1, taken along line 6-6.

As shown generally in FIGS. 1-4, the perimeter wall 106 can have a front wall segment 122 and a back wall segment 124. The front wall segment 122 can have a maximum height greater than a maximum height of the back wall segment 124. The front wall segment 122 can taper down from the maximum height of the front wall segment 122 to the maximum height of the back wall segment 124. For example, FIGS. 5 and 6 depict cross-sectional views of the lid 100 of FIG. 1-4, taken along lines 5-5 and 6-6 (as shown in FIG. 2), respectively. As shown in FIG. 6, the front wall segment 122 can have a maximum height H1, where H1 can be approximately 0.38 to 0.75 inch relative to a top of the mounting portion 102. The back wall segment 124 can have a maximum height H2 to provide an anti-drip edge, where H2 is approximately 0.01 to 0.10 inch relative to a top of the mounting portion 102. Alternatively, for purpose of illustration and not limitation, the back wall segment 124 can be tapered down to 0.0 inch (flush with the top), or the back wall segment 124 can have no taper at all. The center portion 108 can have a maximum height H3 to provide clearance for flush-filled drinks, where H3 is approximately 0.055 to 0.065 inch relative to a top of the mounting portion 102. Alternatively, for purpose of illustration and not limitation, for menu offerings that do not require clearance to flush-filled drinks, the center portion 108 can recess into the top plane of the cup rim. The center portion 108 can have a vent hole 109.

Figure 7:
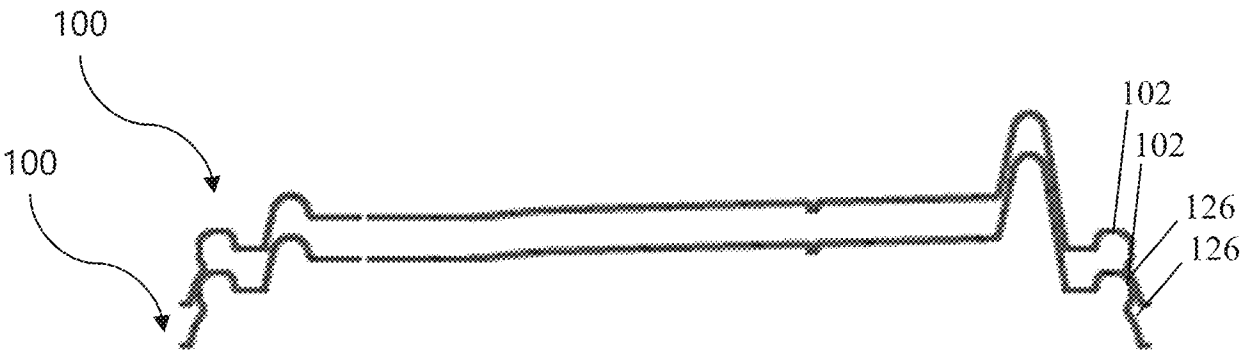
FIG. 7 is a cross-sectional side view of a stacked arrangement of lids of FIG. 1, in accordance with the disclosed subject matter.
Figure 8A:
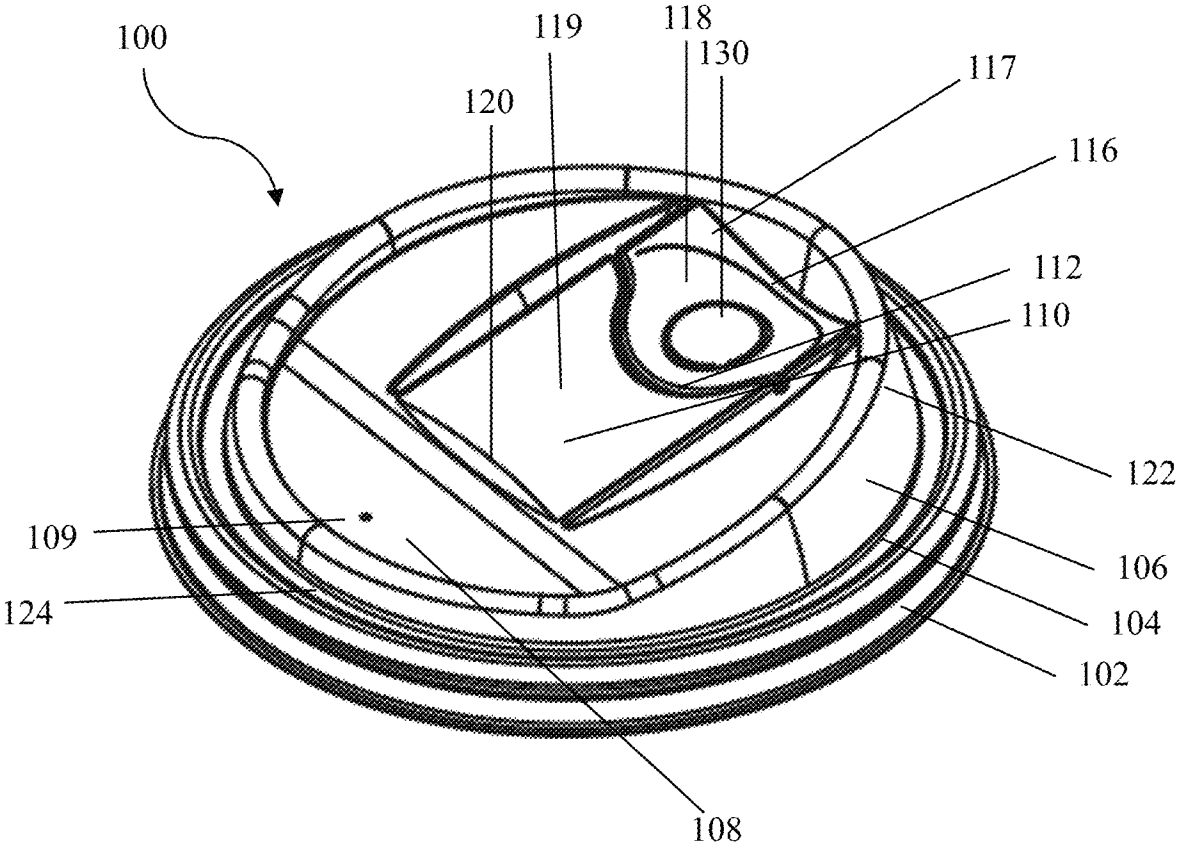
FIG. 8A is a perspective view of a lid for a container according to another aspect of the disclosed subject matter.
Figure 8C:
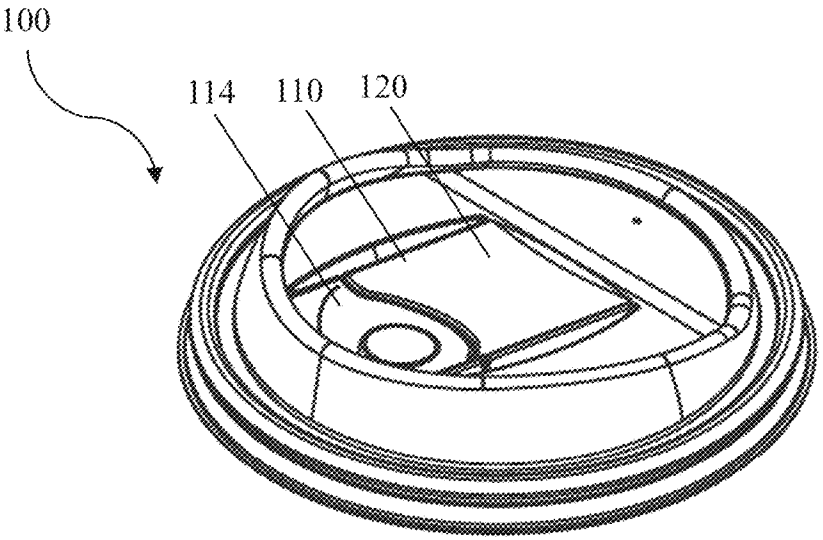
FIG. 8C is a perspective view of the lid of 8A.
Figure 8D:
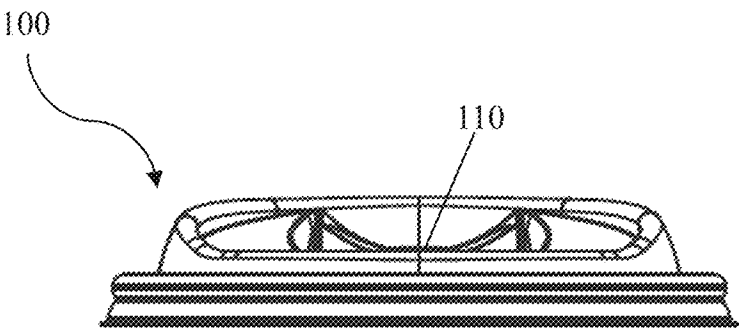
FIG. 8D is a rear side view of the lid of FIG. 8A.
Figure 8B:
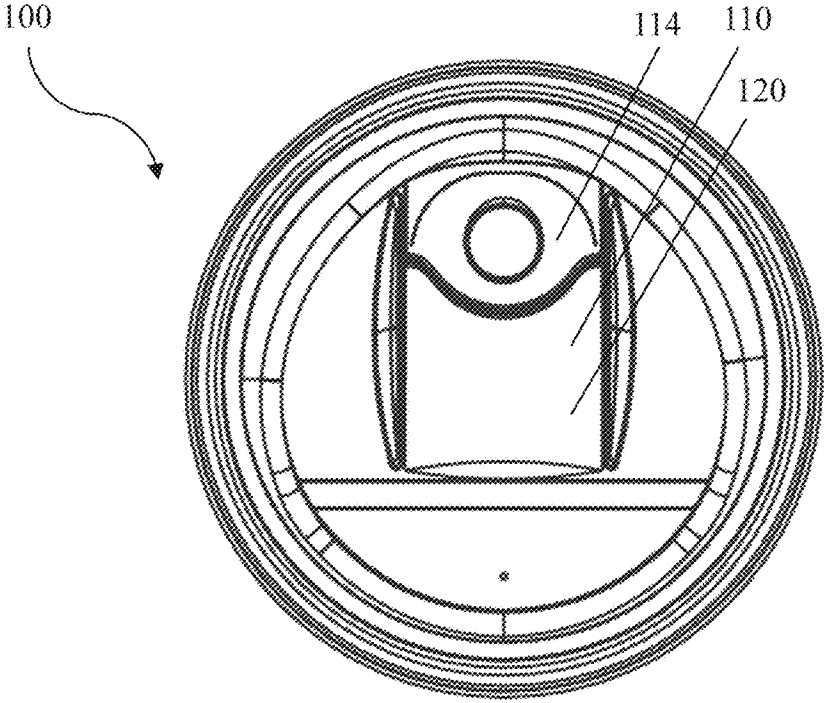
Figure 9A:
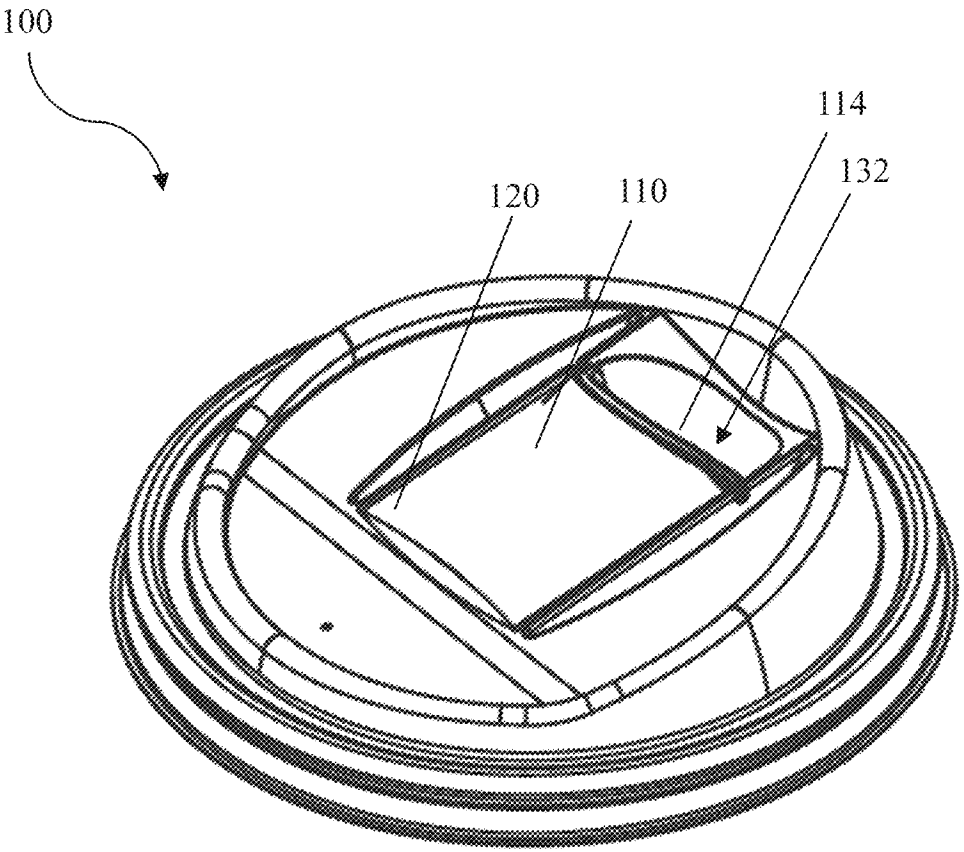
FIG. 9A is a perspective view of the lid of FIG. 8 in the opened configuration.
Figure 9C:
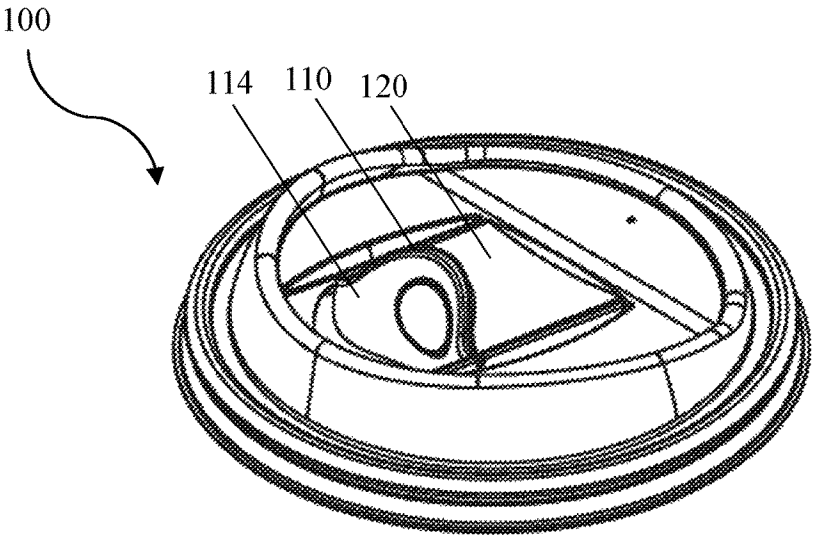
FIG. 9C is a perspective view of the lid of 9A.
Figure 9D:
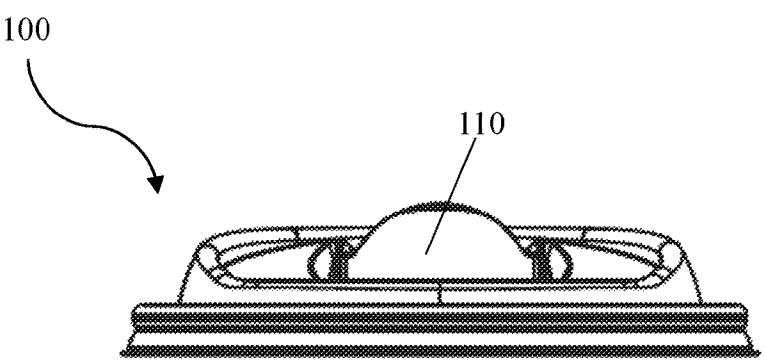
FIG. 9D is a rear side view of the lid of FIG. 9A.
Figure 9B:
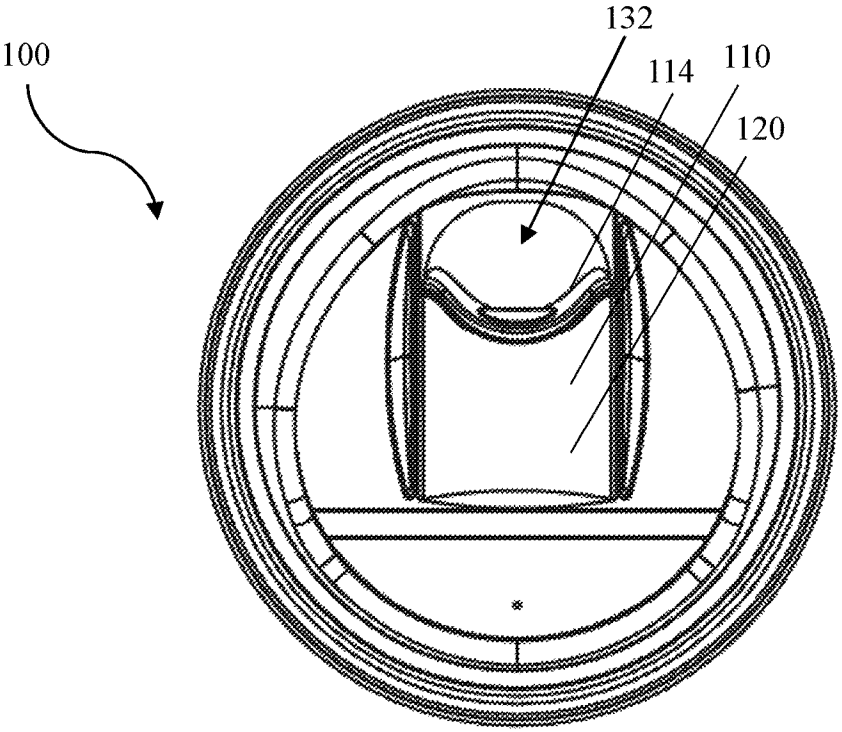

As shown generally in FIGS. 1-4, the mounting portion 102 can be configured to engage an upper rim of a container. The mounting portion 102 can include an inner shelf 104 extending radially inward to the outer surface of the perimeter wall 106. The outer perimeter defined by the mounting portion 102 can be circular in plan view. As shown in FIG. 6, the mounting portion 102 can have a maximum height H4 to create lid-to-cup seal geometry, where H4 can be approximately 0.25 to 0.35 inch. As shown in FIG. 7, which is a cross-sectional side view of a stacked arrangement of lids 100, the mounting portion 102 of each lid 100 can include a stacking feature 128. As shown in FIG. 7, stacking features 128 align and interlock when two containers are stacked, allowing the container lids to nest when stacked.

In accordance with another aspect of the disclosed subject matter, FIGS. 8A-8D and 9A-9D show a strawless drinking lid 100. Lid 100, as shown in FIGS. 8A-8D and 9A-9D, can have one or more features as included in lid 100 in FIGS. 1-4, such as mounting portion 102, inner shelf 104, perimeter wall 106, center portion 108, recessed drinking portion 110, hinge 112, front edge 116, ledge 117, front and back sections 118, 120, upper surface 119, front and back wall sections 122, 124. The front section 118 can have a pressure indicator 130. The pressure indicator 130 can have any suitable shape and dimension, including but not limited to circular and raised. As shown in FIGS. 9A-9D, the recessed drinking portion 110 can be configured to be moved from the closed configuration toward the open configuration by an external opening force applied on the front section 118 of the upper surface 119 to deform both the front and back sections 118, 120 relative to the center portion 108 to create a sip hole opening 132.

In order to create lid 100 in accordance with the disclosed subject matter, a sheet of thermoformable polymeric material can be provided and thermoformed to create a hollow body. For example, the lid 100 can consist essentially of a single-piece thermoformed polymer article. A variety of systems and techniques are known to thermoform a sheet of polymeric material into the general configuration of a container lid. For example, U.S. Pat. Nos. 7,691,302, 7,753,224, 7,789,260, 7,819,271, 8,113,379, and 8,317,050, the contents of which are incorporated herein by reference, disclose various methods of manufacture of container lids. The hollow body can contain one or more of the features as included in lid 100.

In accordance with the disclosed subject matter, the container can be made of a polymeric material. Examples of suitable polymeric materials include, but are not limited to polyethylene terephthalate (PET), unfoamed polyolefin material, and polypropylene polymers, such as, for example polypropylene homopolymers, polypropylene random copolymers, or polypropylene impact polymers, ethylene polymers, such as, for example, high density polyethylene, medium density polyethylene, or low density polyethylene, and mixtures, copolymers, monolayer, laminated multilayer, or coextruded multilayer combinations thereof.

In addition to the disclosed subject matter claimed below, the disclosed subject matter is also directed to other aspects of the disclosed subject matter having any other possible combination of the dependent features claimed below and those disclosed above. As such, the particular features presented in the dependent claims and disclosed above can be combined with each other in other manners within the scope of the disclosed subject matter such that the disclosed subject matter should be recognized as also specifically directed to other aspects of the disclosed subject matter having any other possible combinations. Thus, the foregoing description of the disclosed subject matter has been presented for purposes of illustration and description. It is not intended to be exhaustive or to limit the disclosed subject matter to the aspects of the disclosed subject matter disclosed.

It will be apparent to those skilled in the art that various modifications and variations can be made in the method and system of the disclosed subject matter without departing from the spirit or scope of the disclosed subject matter. Thus, it is intended that the disclosed subject matter include modifications and variations that are within the scope of the appended claims and their equivalents.

What is claimed is:

1. A strawless drinking lid for a container, comprising:

a mounting portion defining an outer perimeter;

a perimeter wall disposed inwardly from the mounting portion, the perimeter wall extending upwardly relative the mounting portion and having an outer surface facing the mounting portion and an inner surface opposite the outer surface;

a center portion extending inwardly from the inner surface of the perimeter wall; and a recessed drinking portion extending from the center portion, the recessed drinking portion including an upper surface having a front section and a back section with a hinge extending across a width of the recessed drinking portion and disposed between the front section and the back section, the front section having a front edge proximate a ledge extending from the inner surface of the perimeter wall, the recessed drinking portion having a closed configuration with the upper surface having an undeformed concave shape relative to the center portion and the front edge adjacent the ledge extending from the inner surface of the perimeter wall, and the recessed drinking portion having an open configuration with the back section of the upper surface deformed upwardly to define an opening between the front edge and the ledge extending from the inner surface of the perimeter wall.

2. The strawless drinking lid of claim 1, wherein the recessed drinking portion is configured to be moved from the closed configuration toward the open configuration by an external opening force applied on the front section of the upper surface to deform the front section relative to the center portion.

3. The strawless drinking lid of claim 1, wherein the recessed drinking portion is configured to be moved from the open configuration toward the closed configuration by an external closing force applied on the back section of the upper surface to return the back section to the undeformed concave shape.

4. The strawless drinking lid of claim 2, wherein the front section is configured to conform to the hinge in the open configuration, and wherein the front section inverts upwardly as the front section conforms to the hinge.

5. The strawless drinking lid of claim 1, wherein the front edge is a curve defined along an interface between the upper surface of the recessed drinking portion and the ledge extending from the inner surface of the perimeter wall.

6. The strawless drinking lid of claim 1, wherein the hinge is a curve defined along an interface between the front section and the back section of the upper surface.

7. The strawless drinking lid of claim 1, wherein the front edge of the recessed drinking portion is defined by a cut, perforation or score.

8. The strawless drinking lid of claim 1, wherein the perimeter wall has a front wall segment and a back wall segment, wherein the front wall segment has a maximum height greater than a maximum height of the back wall segment.

9. The strawless drinking lid of claim 8, wherein the front wall segment tapers down from the maximum height of the front wall segment to the maximum height of the back wall segment.

10. The strawless drinking lid of claim 9, wherein the front wall segment has a maximum height of approximately 0.38 to 0.75 inch relative to a top of the mounting portion.

11. The strawless drinking lid of claim 1, wherein the mounting portion is configured to engage an upper rim of a container.

12. The strawless drinking lid of claim 1, wherein the mounting portion includes an inner shelf extending radially inward to the outer surface of the perimeter wall.

13. The strawless drinking lid of claim 1, wherein the outer perimeter defined by the mounting portion is circular in plan view.

14. The strawless drinking lid of claim 1, wherein the strawless drinking lid consists essentially of a single-piece thermoformed polymer article.

15. The strawless drinking lid of claim 1, wherein the recessed drinking portion is configured to deform past a point of maximum opening stress to hold the lid in the open configuration.

16. The strawless drinking lid of claim 1, wherein the recessed drinking portion is configured to deform past a point of maximum closing stress to hold the lid in the closed configuration.

17. A method of making a strawless drinking lid for a container, comprising:

providing a sheet of thermoformable polymeric material;

thermoforming the sheet to create a hollow body comprising:

a mounting portion defining an outer perimeter;

a perimeter wall disposed inwardly from the mounting portion, the perimeter wall extending upwardly relative the mounting portion and having an outer surface facing the mounting portion and an inner surface opposite the outer surface;

a center portion extending inwardly from the inner surface of the perimeter wall; and a recessed drinking portion extending from the center portion, the recessed drinking portion including an upper surface having a front section and a back section with a hinge extending across a width of the recessed drinking portion and disposed between the front section and the back section, the front section having a front edge proximate a ledge extending from the inner surface of the perimeter wall, the recessed drinking portion having a closed configuration with the upper surface having an undeformed concave shape relative to the center portion and the front edge adjacent the ledge extending from the inner surface of the perimeter wall, and the recessed drinking portion having an open configuration with the back section of the upper surface deformed upwardly to define an opening between the front edge and the ledge extending from the inner surface of the perimeter wall.

18. The method of claim 17, wherein the recessed drinking portion is configured to be moved from the closed configuration toward the open configuration by an external opening force applied on the front section of the upper surface to deform the front section relative to the center portion past a point of maximum closing stress.

19. The method of claim 17, wherein the recessed drinking portion is configured to deform past a point of maximum opening stress to hold the lid in the open configuration.

20. The method of claim 17, wherein the recessed drinking portion is configured to deform past a point of maximum closing stress to hold the lid in the closed configuration.

* * * * *